US010279975B2

(12) United States Patent
Soehnlen et al.

(10) Patent No.: US 10,279,975 B2
(45) Date of Patent: May 7, 2019

(54) BOTTLE WITH PRESSURIZING FEATURE UNDER LATERAL LOAD AND ASSOCIATED METHOD

(71) Applicant: CREATIVE EDGE DESIGN GROUP LTD., Canton, OH (US)

(72) Inventors: Gregory M. Soehnlen, North Canton, OH (US); Alexander Campana, Lorain, OH (US); Daniel P. Soehnlen, Canton, OH (US)

(73) Assignee: CREATIVE EDGE DESIGN GROUP LTD., Canton, OH (US)

( * ) Notice: Subject to any disclaimer, the term of this patent is extended or adjusted under 35 U.S.C. 154(b) by 0 days.

(21) Appl. No.: 15/360,176

(22) Filed: Nov. 23, 2016

(65) Prior Publication Data

US 2017/0152095 A1 Jun. 1, 2017

Related U.S. Application Data

(60) Provisional application No. 62/261,144, filed on Nov. 30, 2015.

(51) Int. Cl.

| | |
|---|---|
| ***B65D 1/02*** | (2006.01) |
| ***B65D 21/02*** | (2006.01) |
| ***B65D 23/10*** | (2006.01) |
| ***B65D 23/14*** | (2006.01) |
| ***B65D 41/04*** | (2006.01) |
| ***B65D 71/06*** | (2006.01) |
| ***B65D 79/00*** | (2006.01) |

(52) U.S. Cl.

CPC ..... *B65D 79/005* (2013.01); *B65D 1/0223* (2013.01); *B65D 1/0246* (2013.01); *B65D 1/0292* (2013.01); *B65D 21/0209* (2013.01); *B65D 23/10* (2013.01); *B65D 23/14* (2013.01); *B65D 41/04* (2013.01); *B65D 71/06* (2013.01)

(58) Field of Classification Search

CPC B65D 1/0246; B65D 79/005; B65D 21/0209; B65D 23/10; B65D 23/14; B65D 41/04; B65D 71/06

USPC ..... 206/449, 499, 509, 504; 222/143; 215/385

See application file for complete search history.

(56) References Cited

U.S. PATENT DOCUMENTS 4,372,455 A * 2/1983 Cochran ..... B29C 49/0073 215/385
4,969,922 A * 11/1990 Platte, Sr. ..... B65D 1/0223 215/383
5,191,988 A * 3/1993 Reil ..... B65D 5/727 215/384

(Continued)

*Primary Examiner* — Chun Hoi Cheung
(74) *Attorney, Agent, or Firm* — Fay Sharpe LLP

(57) ABSTRACT

A bottle is provided for storing an associated fluid product when filled. The bottle includes a first wall having an opening therein that is selectively opened and closed to allow the associated fluid product to be dispensed therethrough or stored in the bottle, respectively. A second wall is spaced from the first wall, and a third wall extending between the first and second walls. A compliant pleat extends along substantially an entirety of the first wall, second wall, and third wall and divides the bottle into first and second portions. The compliant pleat allows the first and second portions to move toward one another in response to a predetermined force and thereby increase pressure in the closed bottle.

23 Claims, 18 Drawing Sheets

(56) References Cited

U.S. PATENT DOCUMENTS

| | | | | |
|---|---|---|---|---|
| 6,068,161 | A * | 5/2000 | Soehnlen | B65D 1/20 215/382 |
| 6,247,507 | B1 | 6/2001 | Soehnlen et al. | |
| 6,371,172 | B2 | 4/2002 | Soehnlen et al. | |
| 6,588,612 | B1 * | 7/2003 | Dorn | B65D 1/18 206/509 |
| 7,040,509 | B2 * | 5/2006 | McLelland | B44D 3/12 206/508 |
| 7,051,891 | B2 * | 5/2006 | Darr | B65D 1/18 215/383 |
| 7,168,582 | B2 * | 1/2007 | Darr | B65D 1/18 215/365 |
| 8,746,453 | B1 * | 6/2014 | Hall | B65D 21/0202 206/504 |
| 9,352,873 | B2 * | 5/2016 | Dorn | B65D 1/0223 |
| 2006/0260971 | A1 * | 11/2006 | Rivera | B65D 21/0231 206/509 |
| 2008/0217200 | A1 * | 9/2008 | Eiten | B65D 21/0202 206/504 |

* cited by examiner

BOTTLE WITH PRESSURIZING FEATURE UNDER LATERAL LOAD AND ASSOCIATED METHOD

This application claims the priority benefit of U.S. provisional application Ser. No. 62/261,144, filed Nov. 30, 2015, the entire disclosure of which is expressly incorporated herein by reference.

BACKGROUND

The present disclosure relates to transporting fluid product in individual bottles or containers that are stacked and/or bundled together, and more particularly to a bottle and associated method that increases stability in dynamic conditions associated with such bottles and shipping of same. The disclosure finds particular application in connection with transporting liquid product such as dairy (e.g., milk), water, juices and related products (e.g., soy milk), although it may also find application in non-food and liquid products, e.g., liquid detergents, soaps, oil, etc.

It is generally known to transport fluid product stored in individual bottles that are disposed in a stacked array, for example, on a pallet for shipping purposes. A commercially successful system, as shown and described in commonly owned U.S. Pat. Nos. 6,068,161; 6,247,507; and 6,371,172—Soehnlen, et al., eliminates use of external cases (e.g., milk crates) by providing strengthening ribs or flutes in the bottle that extend in a substantially vertical direction from adjacent a first or upper wall or surface to a location adjacent a second or lower wall or surface. The strengthening ribs are designed to carry vertical loads in the sidewall from the top wall to the bottom wall. The ribs are designed to be rigid structures to carry the load much like columns in a building. In this way, loads are transferred through the bottles from an upper stacked layer of filled bottles to a lower stacked layer of filled bottles, and/or directly to a pallet without the use of cases.

As a part of the design of the system, substantially planar regions are formed in the top and bottom walls or surfaces of the bottle that cooperate with vertically extending ribs/flutes, the handle, and corners formed between adjacent sidewalls to transfer the load from the top to the bottom wall of each bottle. This parallelepiped design allows the bottles to be stacked one atop the other and more effectively convey vertical forces or loads through the sidewalls. Oftentimes, one of the ribs extends from the top surface and terminates in the sidewall just above the bottom wall of the bottle.

A container opening is formed in the top wall for introducing fluid content into the bottle and also dispensing a fluid therefrom, and the container opening is preferably located adjacent one of the corners, typically opposite from the location of the handle located in an opposite corner. Because the bottle container opening is located adjacent one of the corners i.e. adjacent the perimeter, conventional filling equipment is modified to reposition the filler over the bottle opening. This can lead to a significant capital expenditure to modify or substitute conventional filling equipment to accommodate this arrangement.

The caseless shipping system has proved to be a substantial and commercially successful improvement in the dairy industry, for example, where substantial cost has been eliminated over a bottle design and system that has existed for over 60 years. The incorporation of the load carrying ribs/flutes into the plastic bottle has limited the use of cases, and simultaneously reduced the amount of resin used per unit volume.

The need exists for continued improvement. For example, reduced resin content is always desirable. Increased stability for both static and particularly dynamic conditions is also desirable, and specifically the ability to improve handling of lateral load and pressure. Adaptation of a system to conventional filler would also result in a substantial cost savings.

SUMMARY

An improved bottle is obtained from designing a bottle that is divided into first and second portions that flex relative to one another.

A mechanical arrangement imposes a lateral load on the bottle that urges the first and second portions toward one another in a lateral direction and thereby pressurizes the closed bottle.

In a preferred arrangement, the mechanical hinge extends all the way around the bottle.

In one embodiment, the lateral load is provided by a wrap that surrounds the array of bottles, for example, a shrink or stretch wrap around the stacked array of bottles received on a pallet.

Locating the bottle opening in an offset position more closely positioned toward a geometric center of the upper surface of the bottle allows for use of a traditional filler.

A number of other benefits are associated with the present disclosure including increased stability (particularly in a dynamic situation), a stronger bottle and therefore a corresponding reduction in a required amount of plastic material required to achieve a selective level of strength and rigidity for the bottle than could be achieved with prior designs.

The hinge in the filled, closed/sealed bottle defines first and second compartments that move toward one another in response to an imposed preload, and as a result makes the bottle stronger and more rigid so that increased load can be conveyed vertically through the bottle with less plastic material.

The new bottle is designed to flex, e.g., the bottle will flex outwardly and not leave a depression (plastic deformation) in the bottle.

The location of flexing on the bottle can be selectively altered/changed.

Pouring the fluid contents from the bottle is also improved with the new bottle of the present disclosure.

The new bottle permits use of a smaller diameter cap (e.g., from 48 mm to 43 mm) and the bottle can therefore hold more pressure.

The bottle arrangement is easy to manufacture, and has a reduced weight when compared to a conventional bottle used for the same purposes.

Another advantage is the ability to use less expensive associated equipment (e.g., a conventional filler can be used) since the offset bottle opening is closer to a central axis of the bottle.

Purposefully creating or providing a pleat or hinge to form first and second compartments of the bottle allows movement between the first and second compartments without plastic deformation when the bottle is filled, sealed, and subject to a preload, and the sealed/capped bottle advantageously builds pressure since the bottle volume is reduced in response to the bottle being subjected to a preload.

Purposefully reducing a surface area of the upper wall of the bottle improves pouring and there is no longer a need to be concerned with the same levels of load carrying capabilities since the bottle is under increased pressure (a concept that is the exact opposite of the previous caseless bottle where there is a desire to maximize the surface area of the top wall).

In addition, the new bottle also handles lateral load and pressure better than the previous caseless bottle.

Still other benefits and advantages of the present disclosure will become more apparent from reading and understanding the following detailed description.

DETAILED DESCRIPTION

Figure 1:
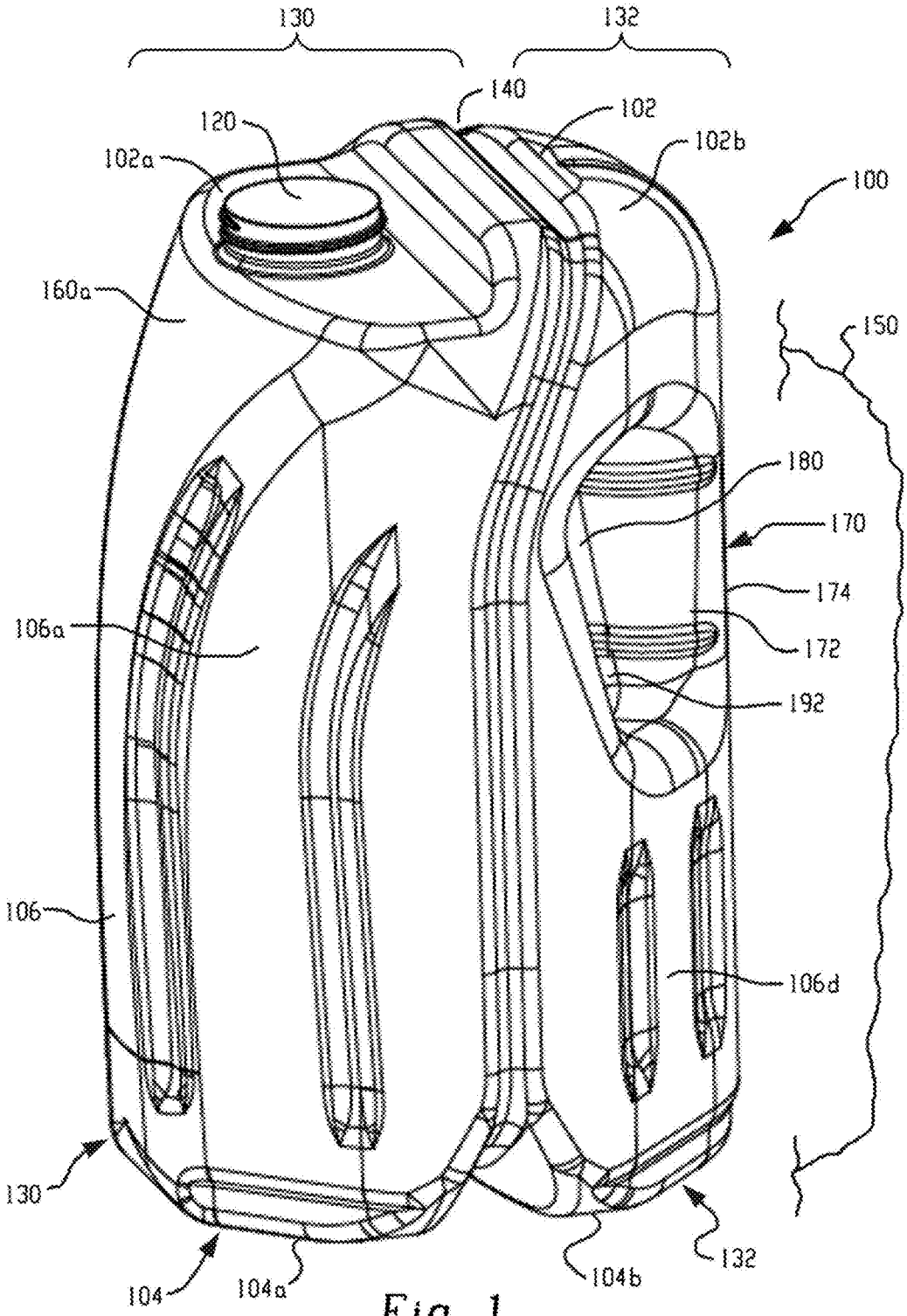
FIG. 1 is a perspective view of a first embodiment of the subject new bottle.

Turning to FIGS. 1-7, there is shown a bottle 100 having a first or top wall 102, a second or bottom wall 104, and a third wall or sidewall 106 interconnecting the top and bottom walls. The sidewall includes generally distinct first, second, third, and fourth sidewall portions 106*a*-106*d*. Adjacent sidewall portions 106*a-d* are disposed generally perpendicular to one another and each sidewall portion is also substantially perpendicular to each of the top and bottom walls. The top wall 102, bottom wall 104, and sidewall 106 enclose a cavity 108. In a preferred arrangement, the bottle 100 is a blow molded plastic structure in which the bottom wall 104 and the sidewall 106 have no openings, while the top wall 102 includes a filling and dispensing opening 110 (FIG. 2) formed therein that is preferably threaded (shown here as an externally threaded neck 112 surrounding the opening). A closure or cap 120 (FIG. 1) is threadably received on the neck 112 and seals the internal cavity 108 formed by the walls once the bottle 100 has been filled with fluid, e.g., milk. Of course other fluid products such as soy milk, almond milk, water, flavored waters, juices, liquid detergents, liquid soaps, oil, etc., can be stored in the bottle without departing from the scope and intent of the present disclosure.

The sidewall portions 106*a*, 106*b* are adjacent one another and together with the region of cavity 108 enclosed by these sidewall portions 106*a*, 106 and those portions of the upper (top) and lower (bottom) walls 102, 104 joining them, form a first compartment or front portion 130 of the bottle 100. Likewise, sidewall portions 106*c*, 106*d* are adjacent one another and together with that region of cavity 108 enclosed by these sidewall portions 106*c*, 106*d* and those portions of the top and bottom walls 102, 104 interconnecting the sidewall portions 106*c*, 106*d*, form a second compartment or rear portion 132 of bottle 100. The front and rear portions or compartments 130, 132 of the bottle 100 are in fluid communication with one another to form the single, continuous internal volume or cavity 108 enclosed or defined by the first, second, and third walls 102, 104, 106 (i.e., the top wall, bottom wall, and sidewall) of the bottle 100. The walls enclosing the first and second compartments 130, 132 are separated/joined by a compliant pleat or hinge 140 (sometimes referenced herein as a mechanical arrangement) that when collapsed in response to a lateral load imposed on the bottle 100 urges the first and second portions/compartments 130, 132 toward one another and thereby pressurizes the bottle when the opening 110 is sealed or closed by cap 120.

In a preferred arrangement, the mechanical hinge 140 extends all the way around the bottle 100. More specifically, sidewall portion 106*a* is joined to the sidewall portion 106*d* via the hinge 140 and likewise sidewall portion 106*b* is joined to the sidewall portion 106*c* via the hinge. Similarly, the hinge 140 divides the top wall 102 into first and second portions 102*a*, 102*b*, and the bottom wall 104 is similarly divided into first and second portions 104*a*, 104*d* by the hinge. As will be described in greater detail below, the hinge/pleat 140 is substantially continuous or in a preferred arrangement is continuous around the bottle 100 and allows the top, bottom, and sidewall portions 102*a*/102*b*, 104*a*/104*b*; 106*b*/106*c*, and 106*a*/106*d* forming the first and second compartments 130, 132 to be spaced apart when the bottle is formed and originally filled with fluid under ambient pressure conditions. As evident in the top plan view of FIG. 4 and the cross-sectional view of FIG. 5, the corner regions between adjacent sidewall portions are more naturally rounded at the apex between sidewall portions 106*a*/106*b*, and 106*c*/106*d* while the mechanical hinge or pleat 140 forms an inward detent at the interface between sidewall portions 106*a*/106*d* and 106*b*/106*c*.

Once a predetermined amount of the fluid is introduced into the bottle 100 through the opening 110, the bottle is sealed or closed by the cap 120. The cap 120 is threaded onto the externally threaded neck 112 around the opening 110 and the cap forms a fluid tight seal of the opening, and/or a foil seal may be heat fused or sealed around the perimeter of the opening. A preload or lateral force is then imposed on the sealed, filled bottle 100 to collapse the pleat 140 and allow the top, bottom, and sidewall portions forming the first and second compartments 130, 132 of the bottle to move toward one another and thereby reduce the volume of the internal cavity 108. Since the filled bottle 100 is sealed, the lateral force increases pressure inside the bottle as a consequence of the internal volume of the cavity 108 being reduced as the first and second compartments 130, 132 are moved toward one another when the pleat/hinge 140 is collapsed. The increased internal pressure adds further strength and rigidity to the sealed bottle 100.

A preferred manner of increasing the internal pressure of the sealed bottle 100 by collapsing the first and second compartments 130, 132 relative to one another is to apply a preload or lateral force by tightly bounding a group or array of sealed bottles with a surrounding stretch or shrink wrap 150. As a result of this preload or lateral force applied by the wrap 150 on the bottle 100, pressure above ambient is created in the sealed bottle. A pre-stretch can be induced in the wrap 150 whereby the wrap wants to relax to its original stretch length thereby shrinking the internal cavity 108 of the bottle by urging the first and second compartments 130, 132 together as the hinge/pleat 140 is collapsed.

The bottle 100 may further include a flexible label (not shown) that extends about the third wall or sidewall 106 and is dimensioned to impose a second preload force on each bottle and increase the pressure in the bottle.

To facilitate the movement of the first and second compartments 130, 132, the wall thickness of the bottle 100 in the hinge/pleat 140 is different than a wall thickness of other portions of the bottle, e.g., wall thickness of the wall portion 106. In a preferred arrangement, the wall thickness of the pleat/hinge is approximately 0.020 inches while the associated wall thickness of the sidewall 106 (or sidewall portions) is approximately 0.015 inches, of course other dimensions may be used without departing from the scope and intent of the present disclosure but a relative percentage differences wall thickness facilitates initial movement of the first and second compartments 130, 132 in response to a lateral load applied to a filled, sealed bottle 100 that results in increased pressure in the sealed bottle.

The bottle 100 of the present disclosure has improved pouring features. Specifically, the opening 110 is moved away from the sidewall 106 and closer to a central axis of the bottle. As particularly evident in FIG. 4, the opening 110 is disposed closer to a central axis of the bottle 100 than the opening is to the sidewall. This slight offset of the opening 110 from the central axis of the bottle allows a manufacturer such as a dairy to use a conventional filler (not shown) such as is widely used in the industry in connection with bottles that have the opening located in the center of the top wall. In addition, upper regions 160*a*, 160*b* (approximately upper one-third) of the sidewall portions 102*a*, 102*b* taper toward the central axis of the bottle 100 from the lower sidewall portions (approximately lower two-thirds). This is a substantial departure from the structure of the commonly owned caseless bottle shown and described in U.S. Pat. Nos. 6,068,161; 6,247,507; and 6,371,172 which seeks to maximize the surface area of the top wall 102. As a result, the consumer can pour fluid contents from the bottle 100 more easily as a result of the taper regions 160*a*, 160*b*, as well as the location of the opening 110 closer to the central axis of the bottle and spaced a greater dimension from the vertically extending portions of the sidewall. This is advantageous so that the offset opening 110 can be used with many existing fillers that already are commercially installed and widely used in the industry in connection with other bottle configurations used in the industry (including a standard/conventional bottle configuration that has been and continues to be commercially produced since the nineteen sixties to date when plastic blow molded bottles replaced similarly configured glass bottles) and because the offset, central opening 110 is at a pour location that consumers are more accustomed to and have used for a long period of time. The consumer is comfortable with how the fluid pours from the opening 110, and need not re-train themselves to grow accustomed to other locations of the opening when pouring contents from the bottle 100.

A handle 170 is provided in the bottle 100. The handle 170 is a non-pass-through handle in the embodiment of FIGS. 1-7 that has an ergonomic shape formed partially in the third and fourth sidewall portions 106*c*, 106*d*. A main portion of the handle 170 has a substantially cylindrical conformation 172 and another portion 174 of the cylindrical conformation merges into an apex interconnecting the third and fourth sidewall portions 106*c*, 106*d*. The circumferential region 174 of the cylindrical portion 172 of the handle 170 tangentially merges into the apex joining the third and fourth sidewall portions 106*c*, 106*d* together. At a portion 176 of the handle 170 opposite the apex portion 174, the third and fourth sidewall portions 106*c*, 106*d* have recessed or depressed regions 178, 180, respectively, that extend inwardly from the substantially planar regions 106*c*, 106*d*, respectively, toward one another. The depressed regions 178, 180 are generally parallel to one another, and form a "no pass structure", i.e., no through opening is formed inwardly of the portion 176 of the generally cylindrical conformation 172 of the handle 170.

The unique configuration or shape of the handle 170 is dimensioned to conform to a generally C-shape contour formed by a user's thumb and index finger when the fingers of a user's hand are stretched and shaped over a virtual cylindrical or hemispherical surface. Thus, the thumb and index finger (as well as the remaining fingers) are received over the cylindrical conformation portion 172 of the handle 170. The palm of the user's hand is received over the circumferential region 174 of the handle 170, and likewise conforms to the convex contour 124*b* of the handle defined along the apex of the sidewall portions 106*c*, 106*d*. The fingers and thumb of the user grip the handle 170 along the cylindrical conformation 172 disposed in each of the first and third sidewall portions 106*c*, 106*d*, respectively,—depending on whether the user grips the handle 170 with the right or left hand. Interconnecting portions 190, 192 of the first and third sidewall portions 106*c*, 106*d* each have a compound, curvilinear conformation in a generally horizontal plane where the sidewall curves outwardly from the respective depressed regions 178, 180 toward the sidewall 106 and where the curvilinear conformation smoothly merges into the large planar sidewall portions 106*c*, 106*d*, respectively.

The upper wall 102 has an arch shape (see FIG. 3) where the respective sidewall portions 106*a-d* merge with the upper wall. The upper wall 102 includes the opening 110 and the opening is more centrally located therein, although as perhaps most evident in FIG. 4, the opening is not at the geometric center but is slightly offset for the reasons described above.

Figure 2:
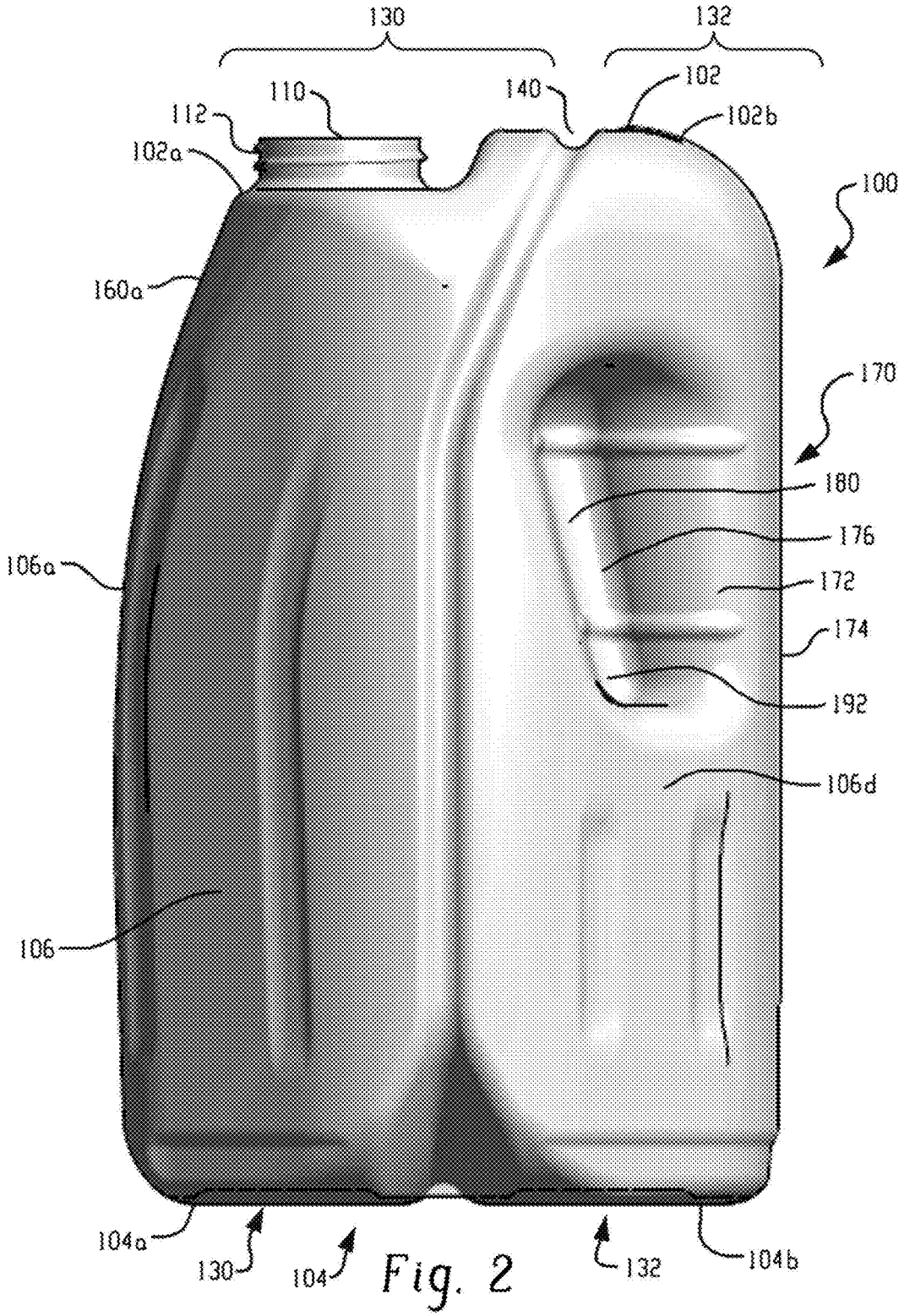
FIG. 2 is an elevational view of the bottle of FIG. 1.
Figure 3:
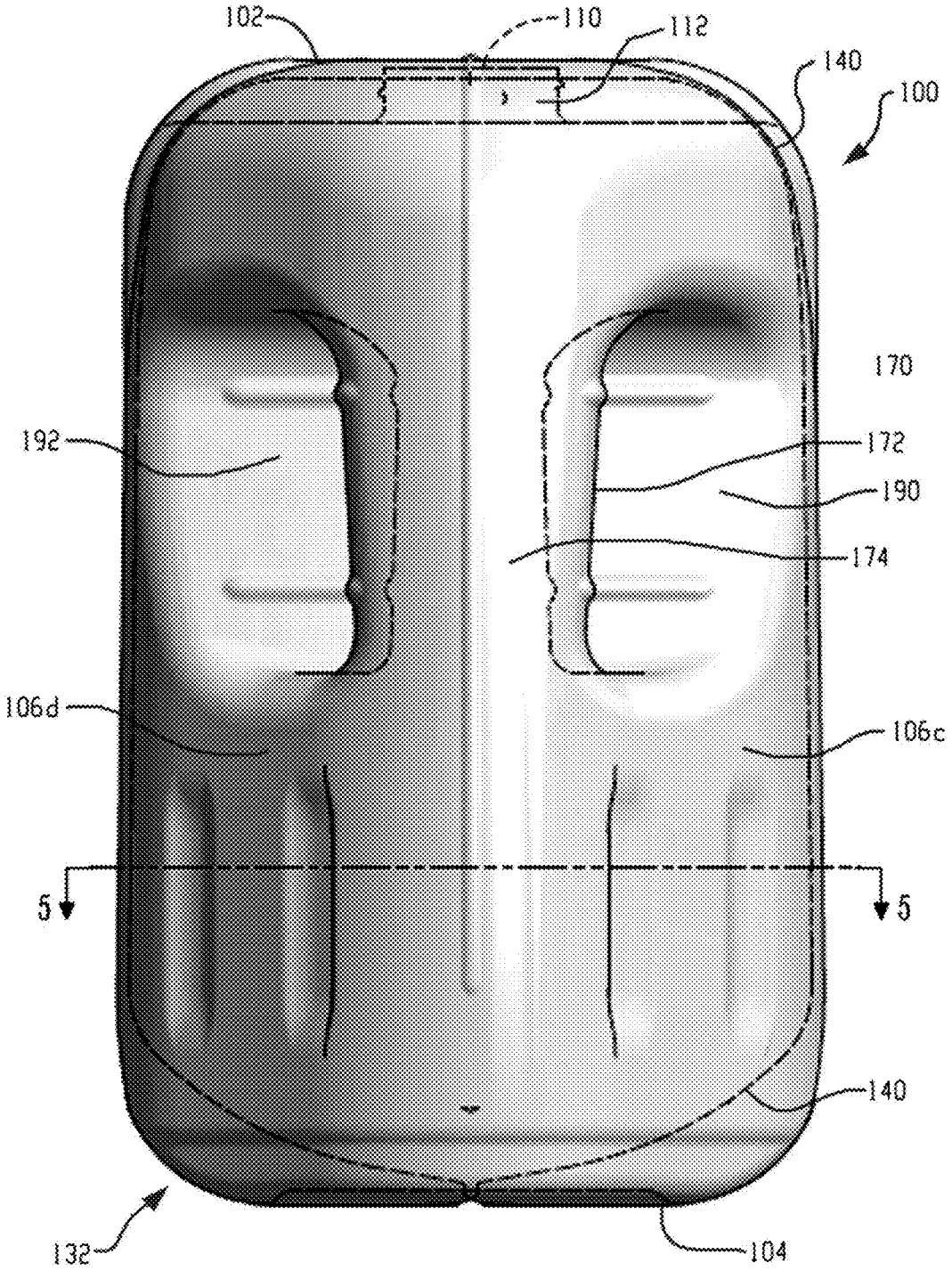
FIG. 3 is an elevational view of the bottle of FIG. 1 taken from the right-hand side of FIG. 2.
Figure 4:
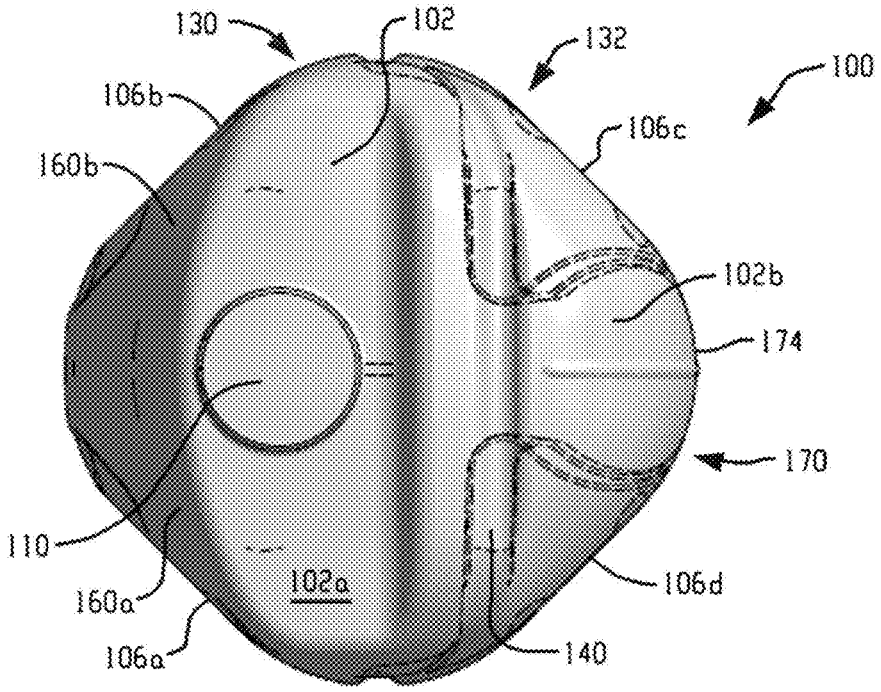
FIG. 4 is a top plan view of the bottle of FIG. 1.
Figure 5:
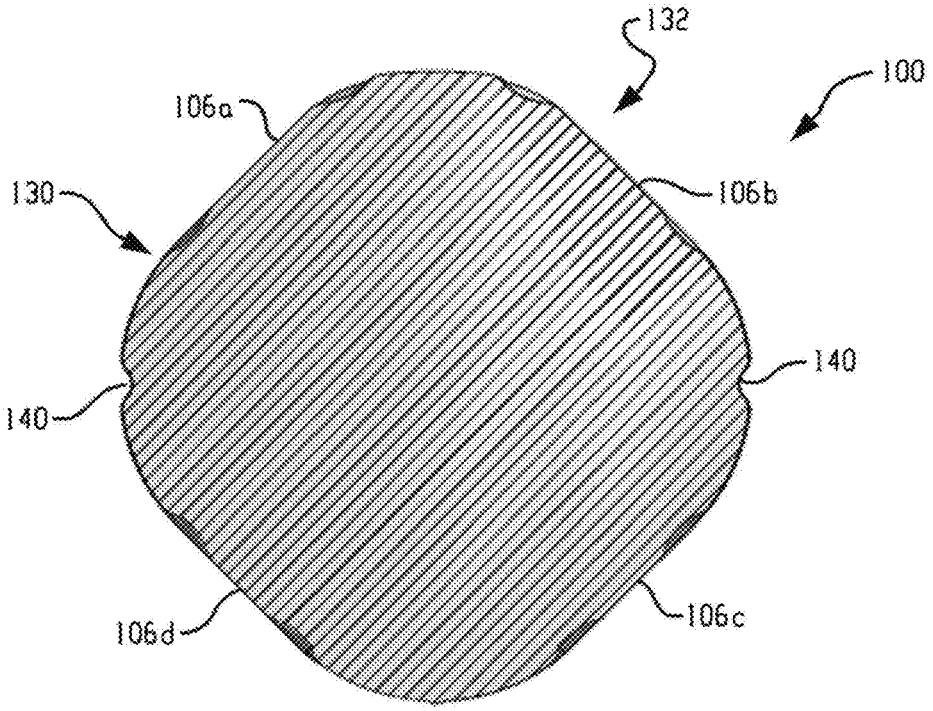
FIG. 5 is a sectional view taken generally along the lines 5-5 of FIG. 3.

The upper wall 102 has a stepped configuration in which a first portion 102*a* includes the externally threaded neck 112 extending outwardly therefrom. The upper perimeter edge of the neck 112 is essentially flush or even in a horizontal plane with a second portion 102*b* of the upper wall (see FIGS. 2-3). It is also evident that the pleat/hinge 140 preferably traverses the upper wall 102 in the second portion 102*b*. Thus as seen in FIGS. 1 and 2, the pleat/hinge 140 extends vertically from the bottom wall 104 until the hinge reaches a vertical height of the upper portion of the handle 170. In that upper region, the pleat/hinge 140 then proceeds at an angle over the handle 170 and into the second portion 102*b* of the upper wall 102. The angle of the pleat/hinge 140 also is roughly parallel with the angled contour in the upper portion of the interface between the first and second sidewall portions 106*a*, 106*b*. By orienting the pleat/hinge 140 along an angle into the second portion 102*b* of the upper wall, the opening 110 is brought closer to the geometric center of the bottle 100.

Figure 6:
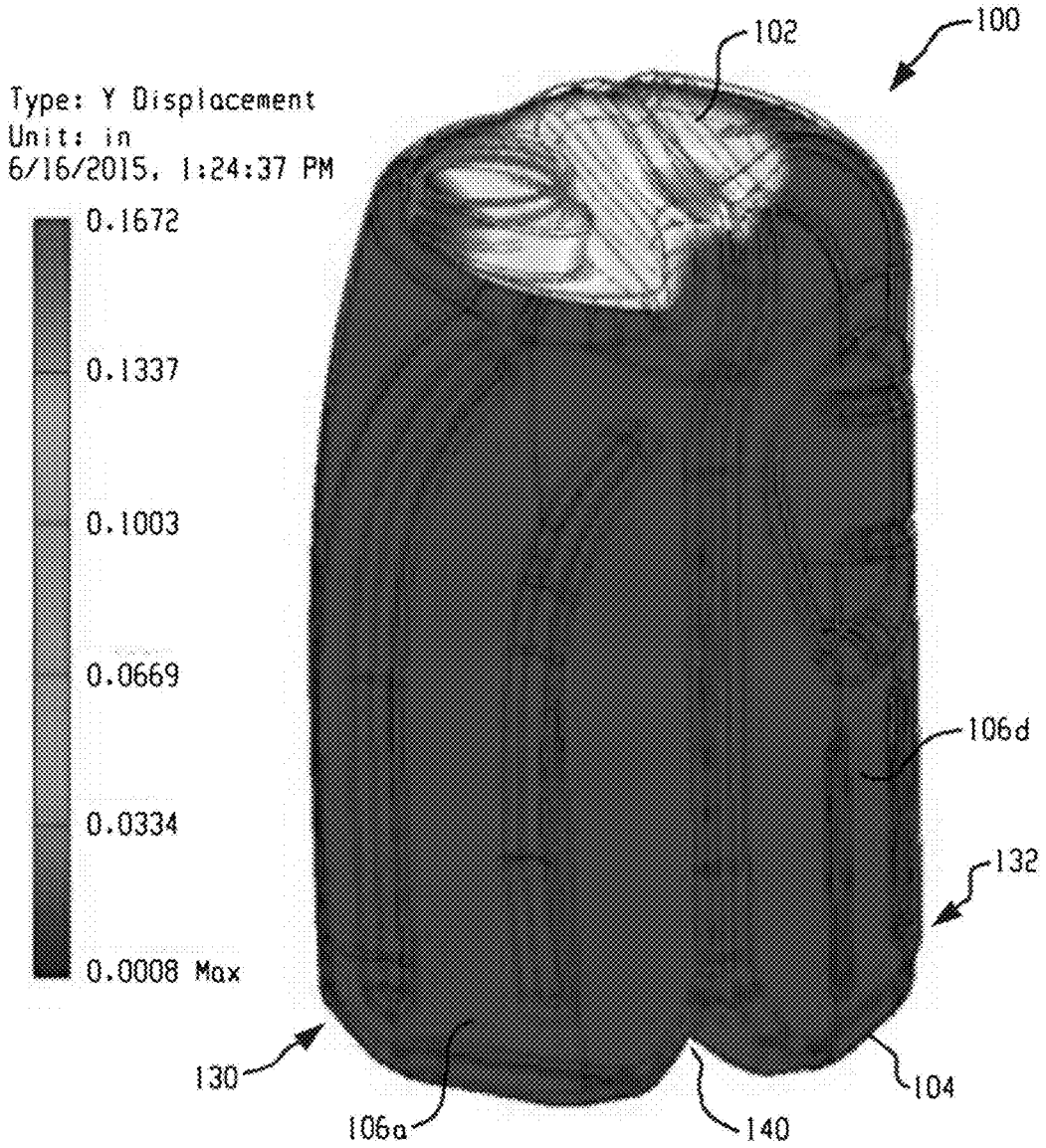
FIG. 6 is a perspective view of the same bottle prior to imposing a preload.
Figure 7:
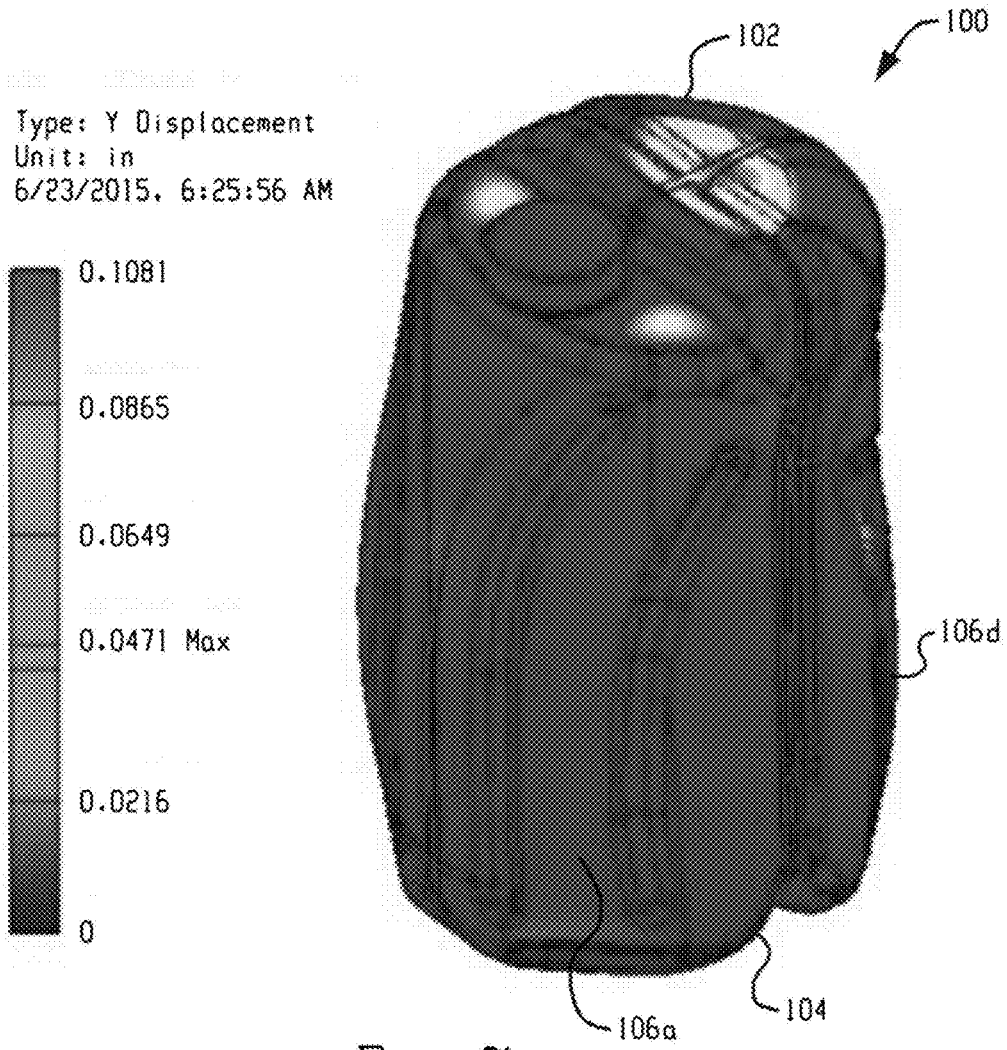
FIG. 7 is a perspective view similar to FIG. 6 and illustrating a raised upper surface of the bottle in response to the applied preload.
Figure 8:
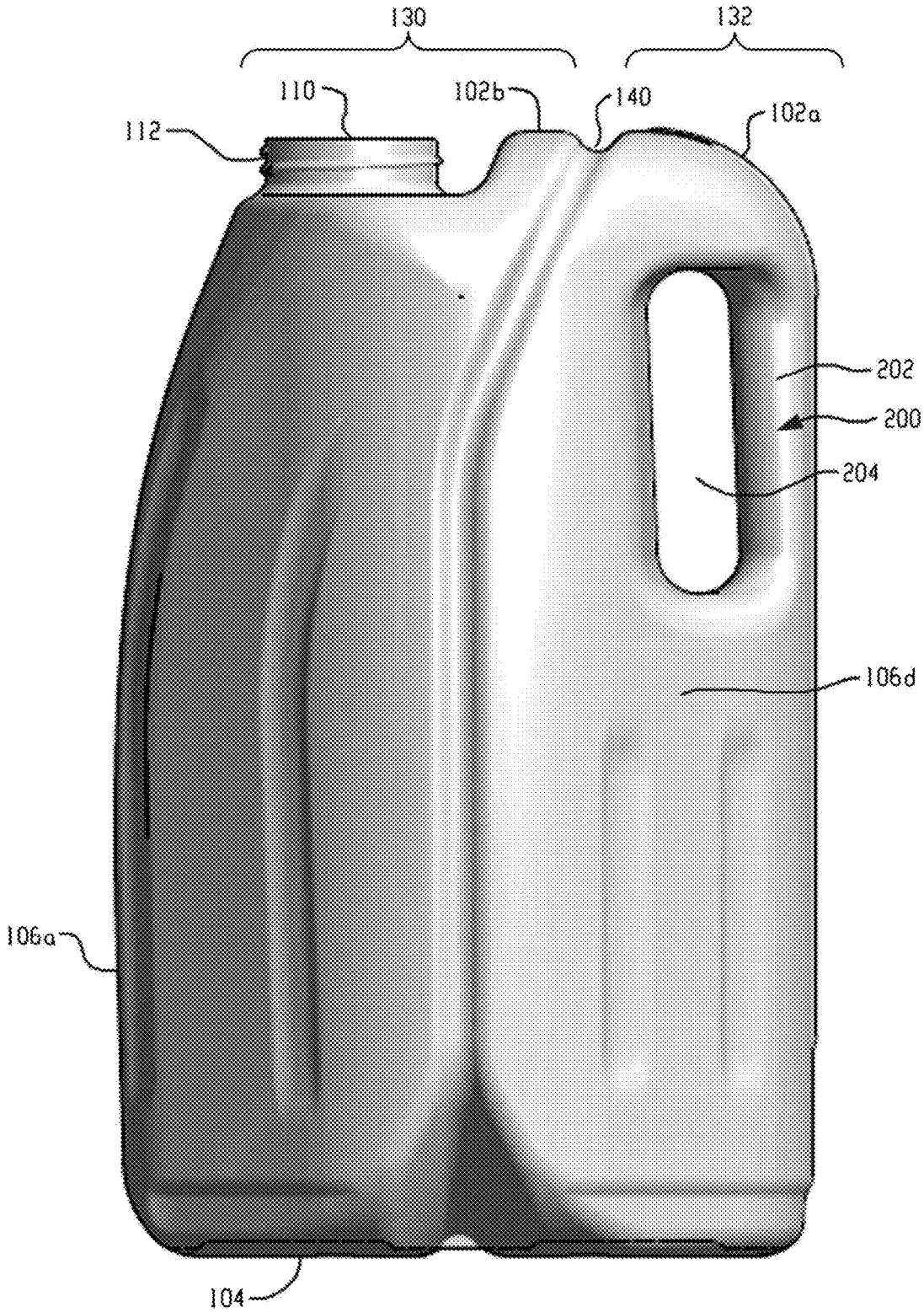
FIG. 8 is an elevational view of the subject new bottle with a pass-through handle.
Figure 9:
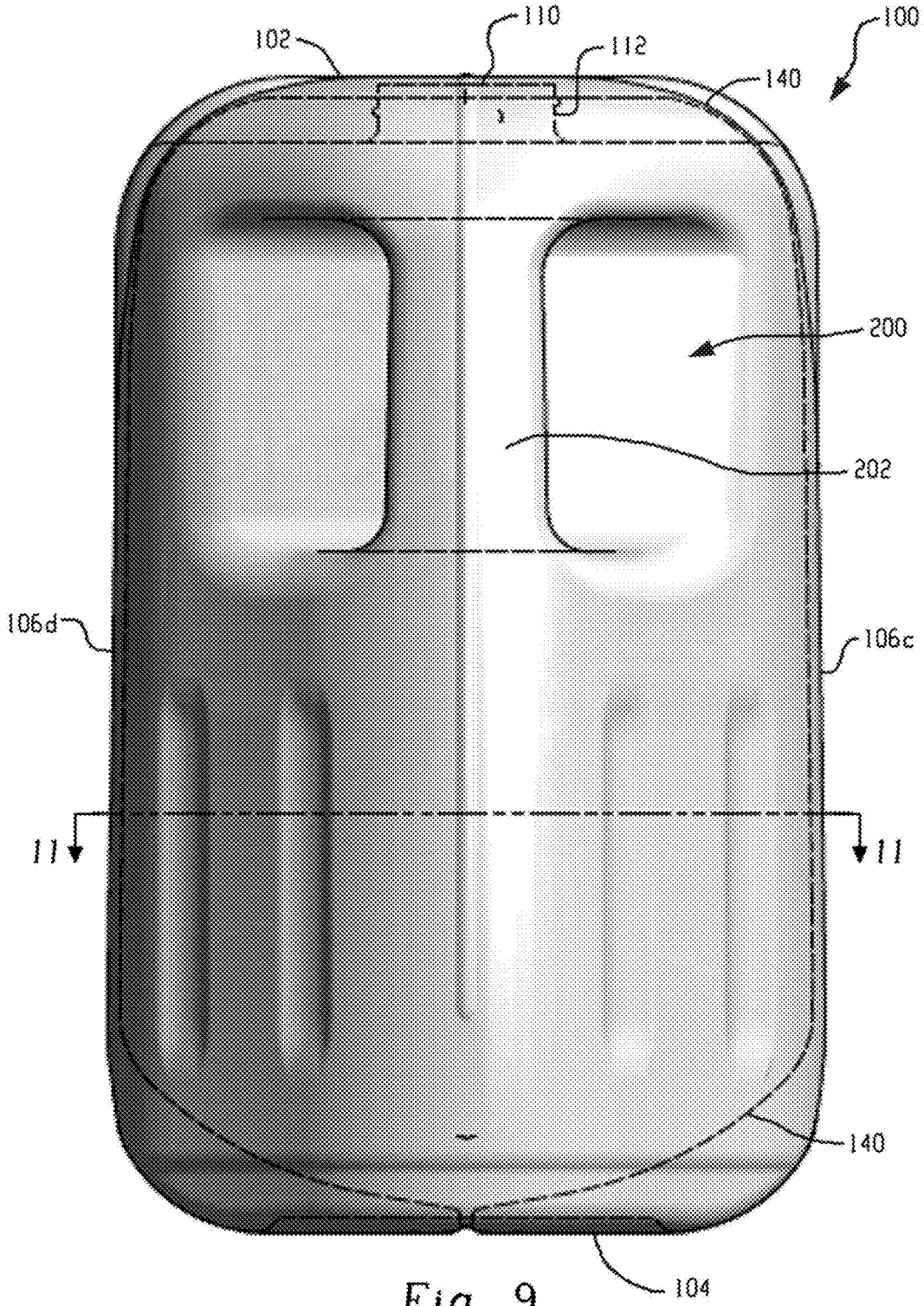
FIG. 9 is an elevational view of the bottle of FIG. 8 taken from the right-hand side of FIG. 8.
Figure 10:
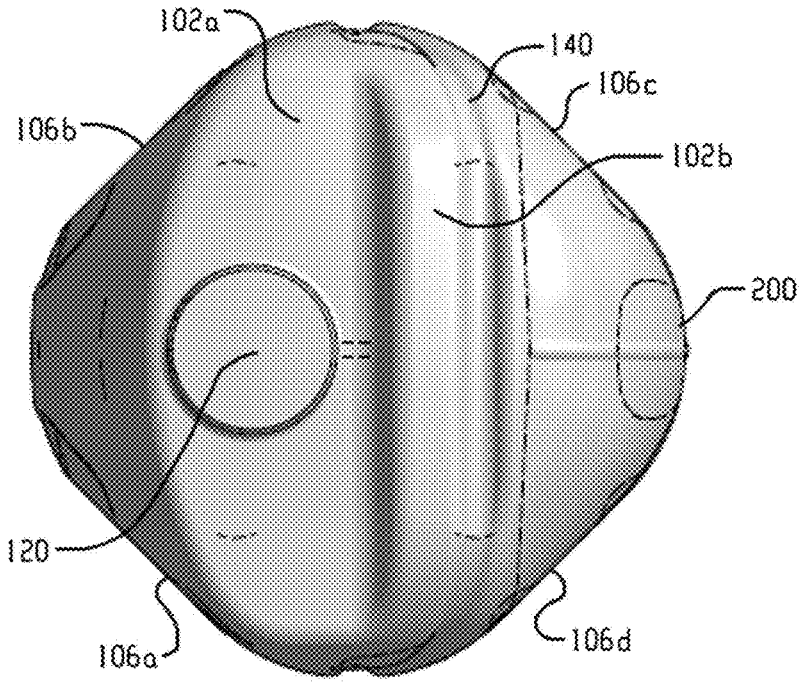
FIG. 10 is a top plan view of the bottle of FIG. 8.
Figure 11:
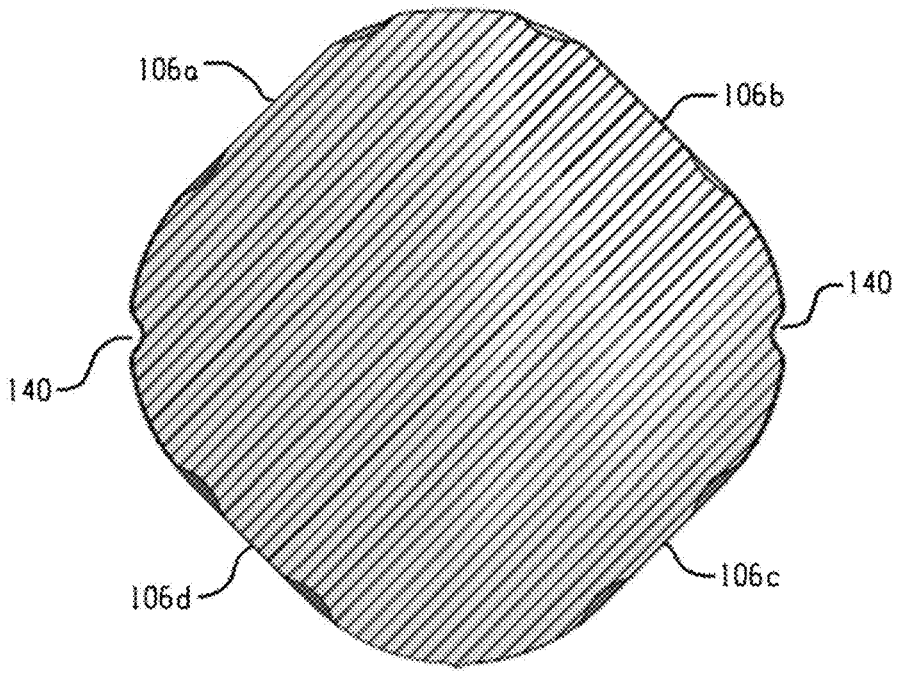
FIG. 11 is a sectional view taken generally along the lines 11-11 of FIG. 9.
Figure 12:
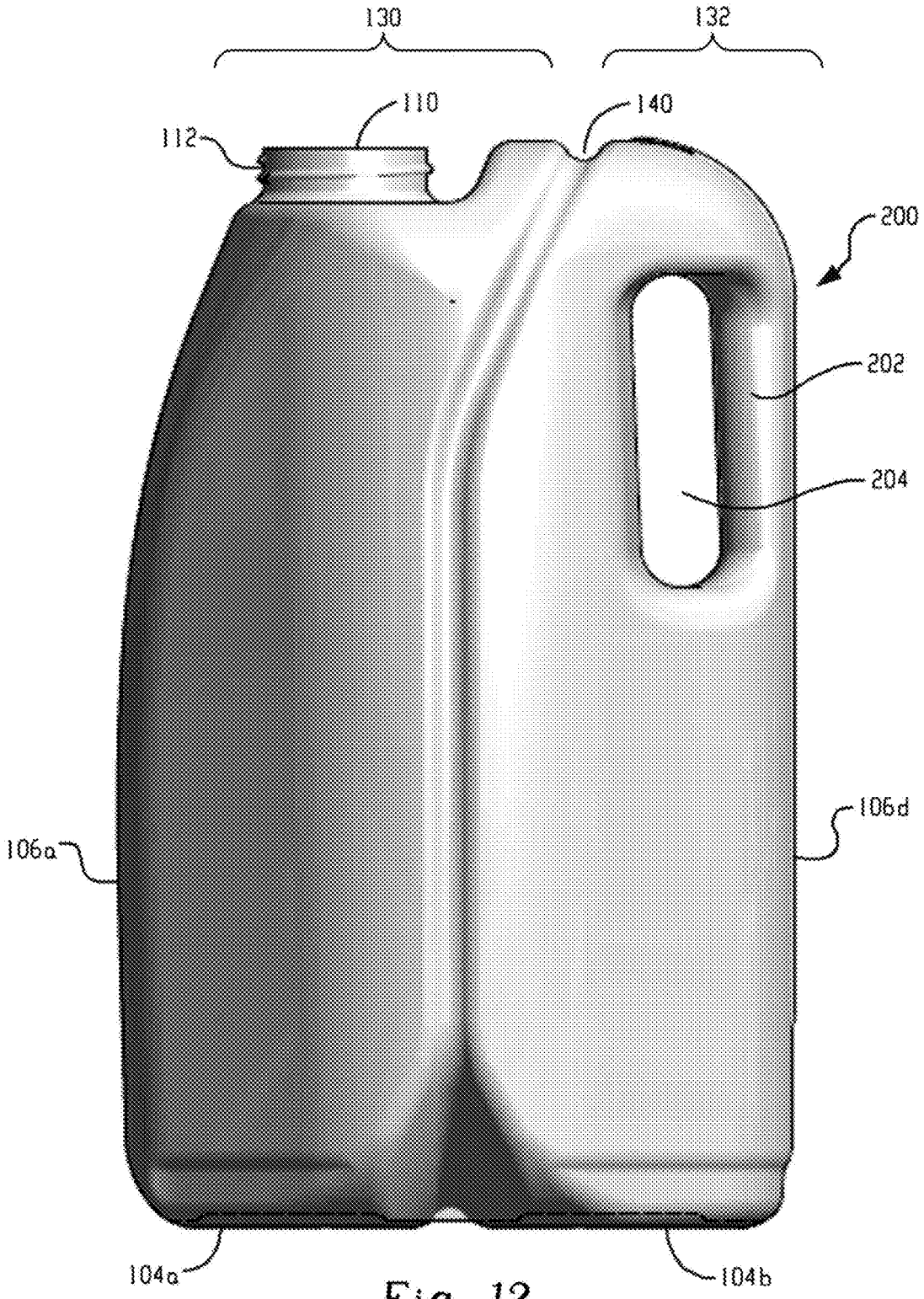
FIG. 12 is an elevational view of the subject new bottle with a pass-through handle and without vertical ribs or flutes.
Figure 13:
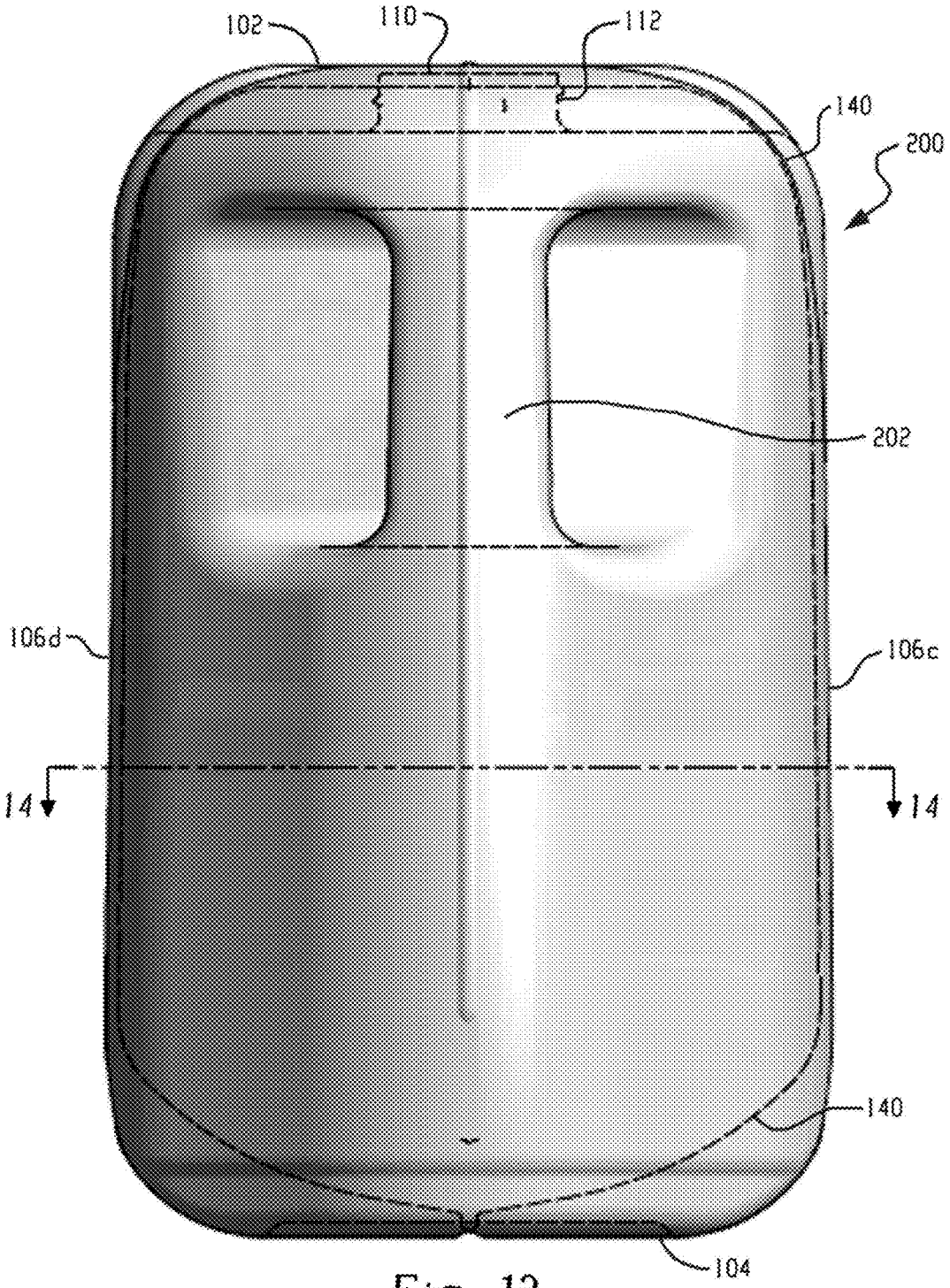
FIG. 13 is an elevational view of the bottle of FIG. 12 taken from the right-hand side of FIG. 12.
Figure 14:
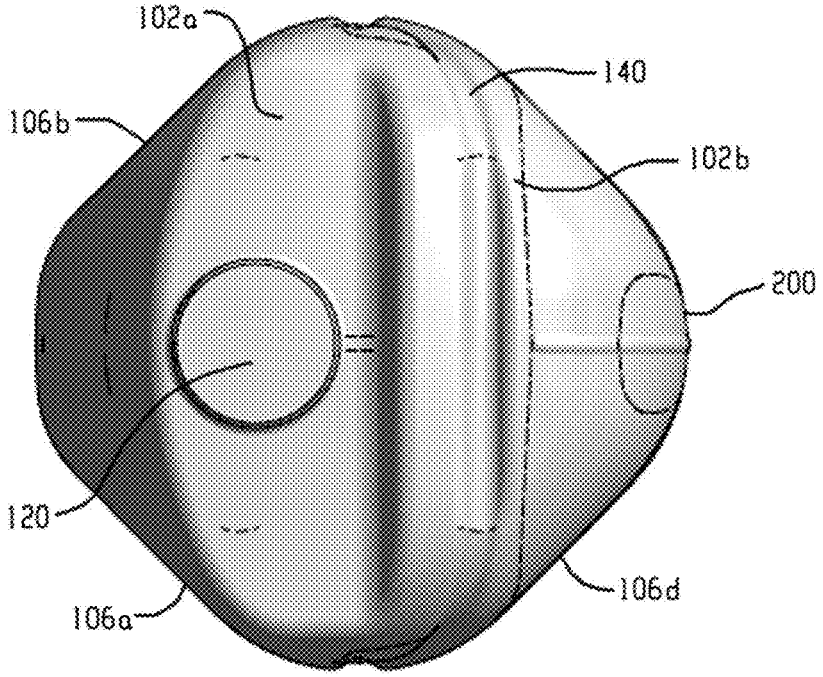
FIG. 14 is a top plan view of the bottle of FIG. 12.
Figure 15:
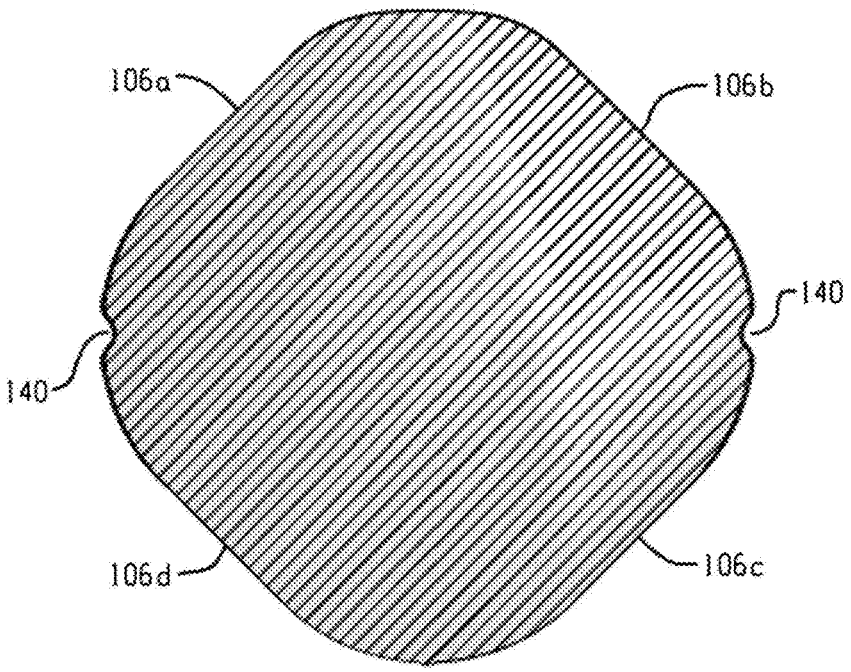
FIG. 15 is a sectional view taken generally along the lines 15-15 of FIG. 9.
Figure 16:
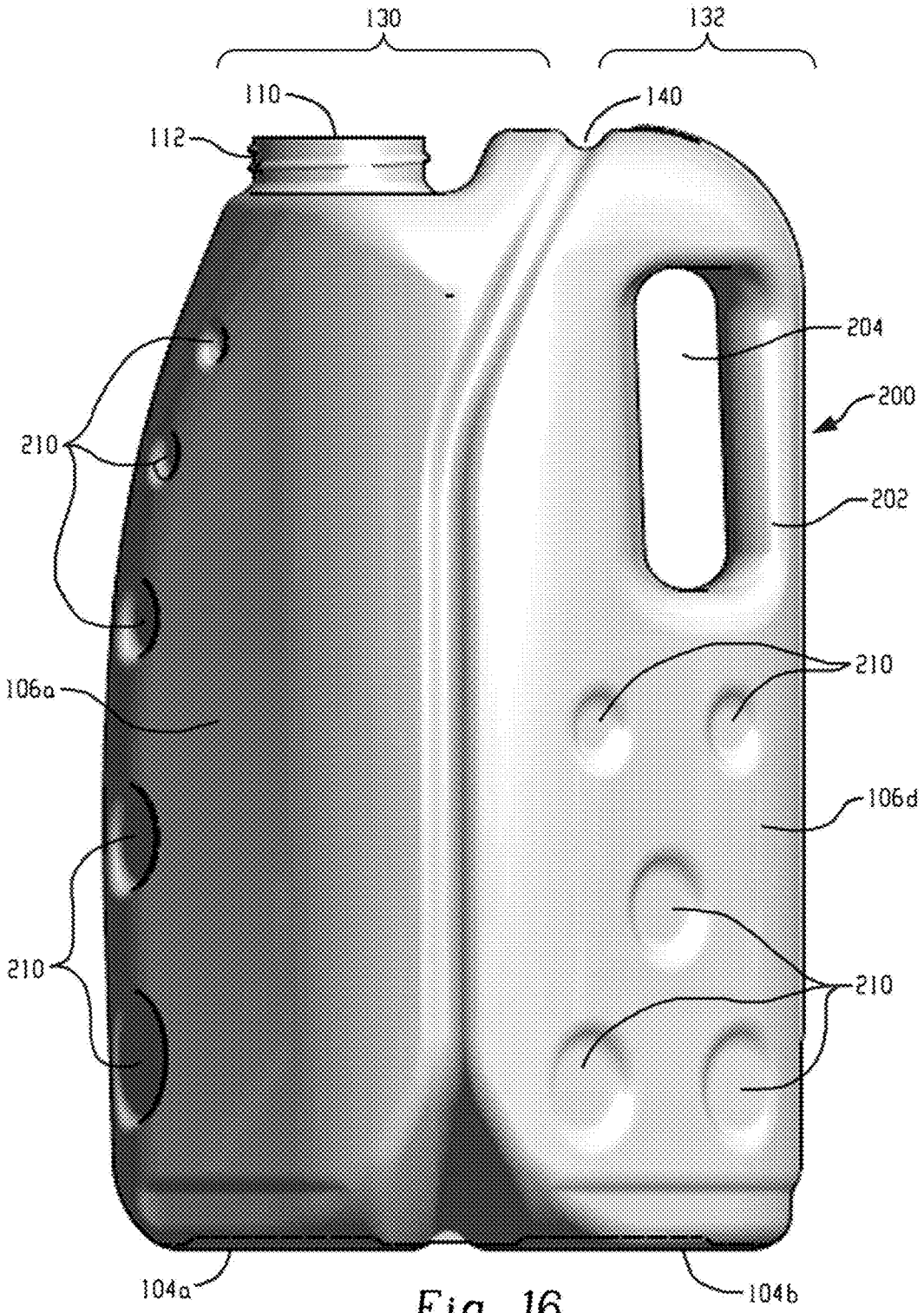
FIG. 16 is an elevational view of the subject new bottle with pressure building regions in select locations of the bottle sidewall.
Figure 17:
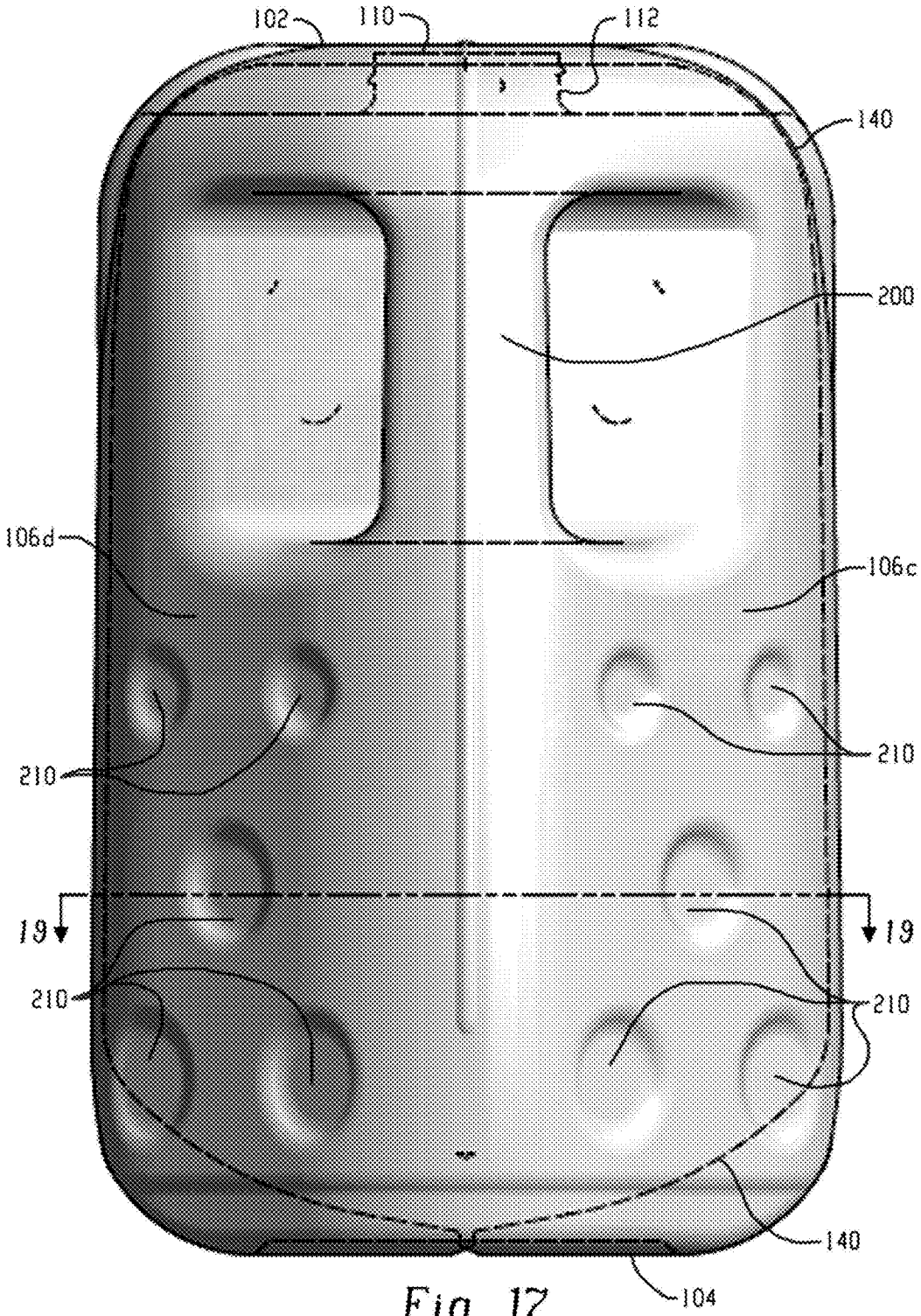
FIG. 17 is an elevational view of the bottle of FIG. 16 taken from the right-hand side of FIG. 16.
Figure 18:
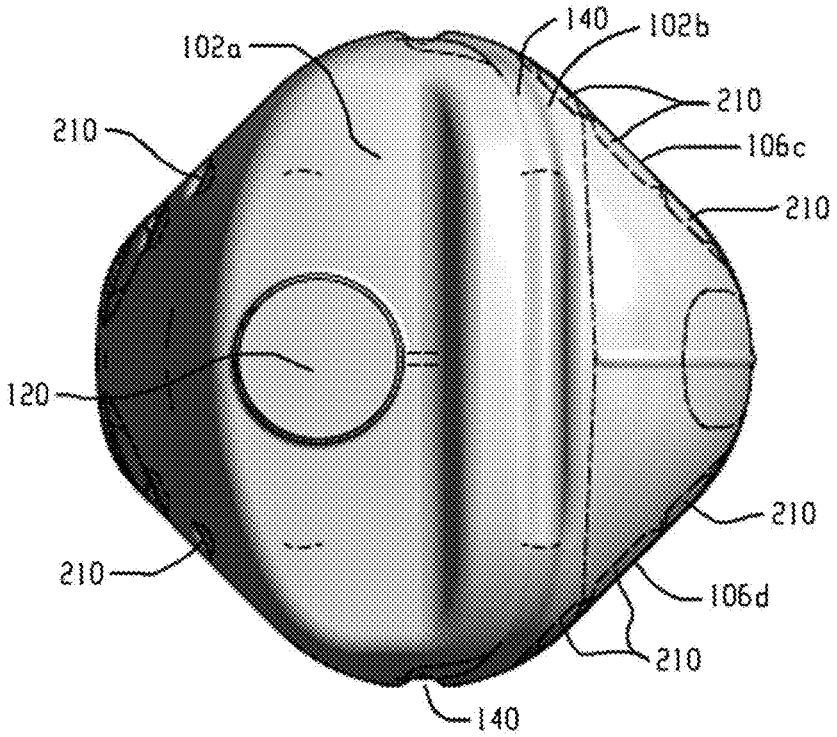
FIG. 18 is a top plan view of the bottle of FIG. 16.
Figure 19:
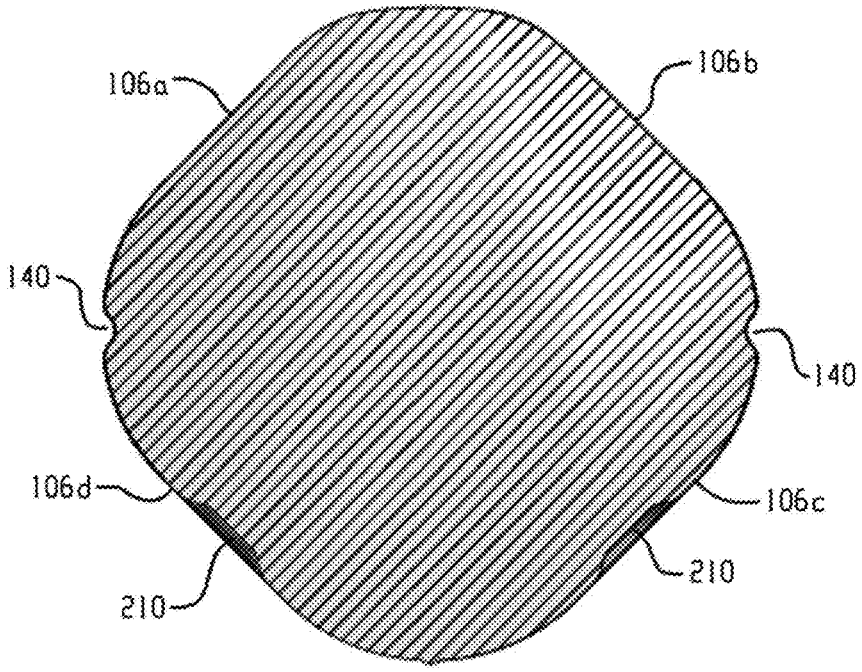
FIG. 19 is a sectional view taken generally along the lines 19-19 of FIG. 17.
Figure 20:
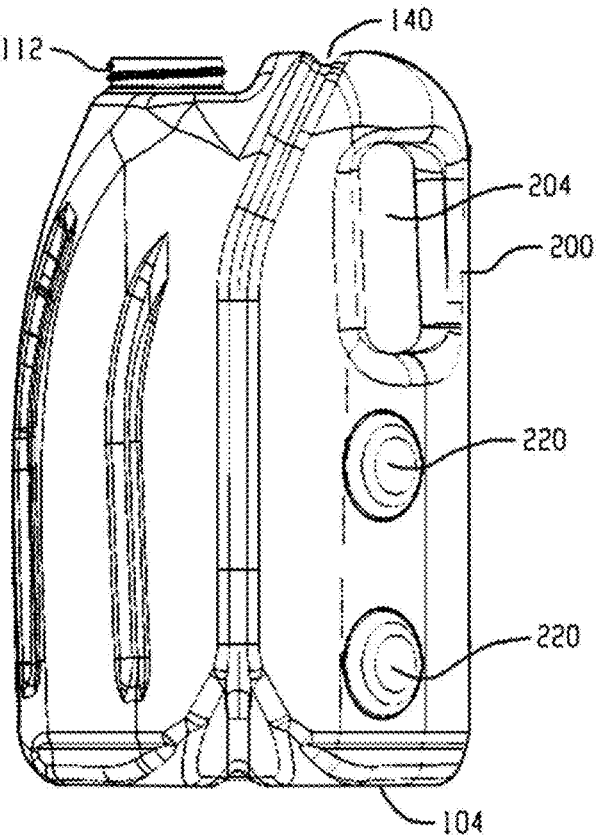
FIG. 20 is an elevational view of the subject new bottle with a different pattern of pressure building regions in select locations of the sidewall.
Figure 21:
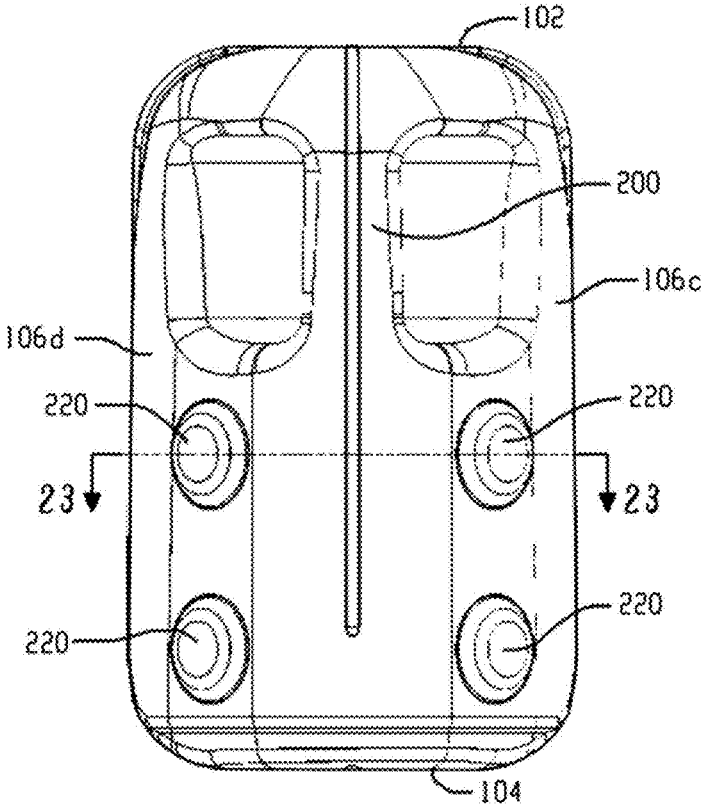
FIG. 21 is an elevational view of the bottle of FIG. 20 taken from the right-hand side of FIG. 20.
Figure 22:
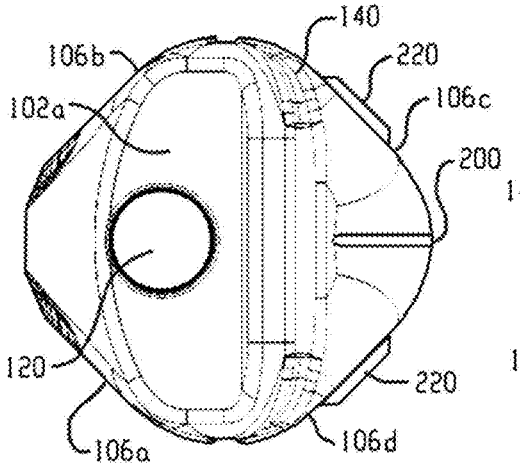
FIG. 22 is a top plan view of the bottle of FIG. 20.
Figure 23:
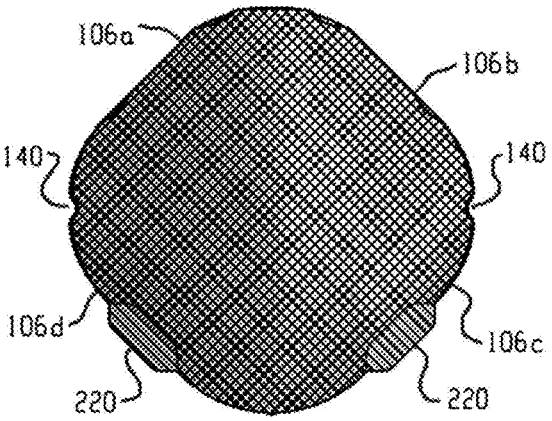
FIG. 23 is a sectional view taken generally along the lines 23-23 of FIG. 21.
Figure 24:
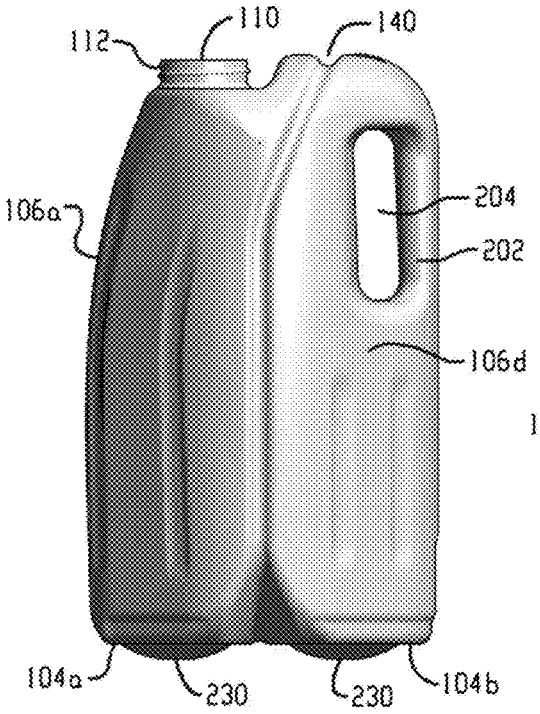
FIG. 24 is an elevational view of the subject new bottle with a pressure building region incorporated into the bottom wall.
Figure 25:
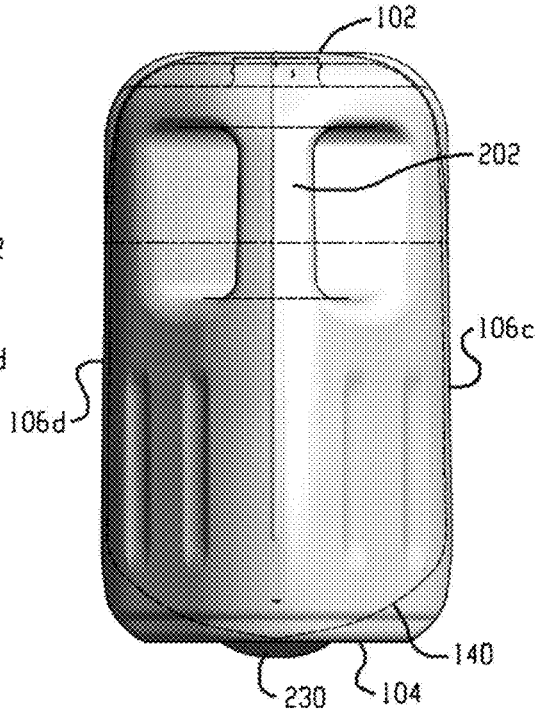
FIG. 25 is an elevational view taken generally from the right-hand side of FIG. 24.
Figure 26:
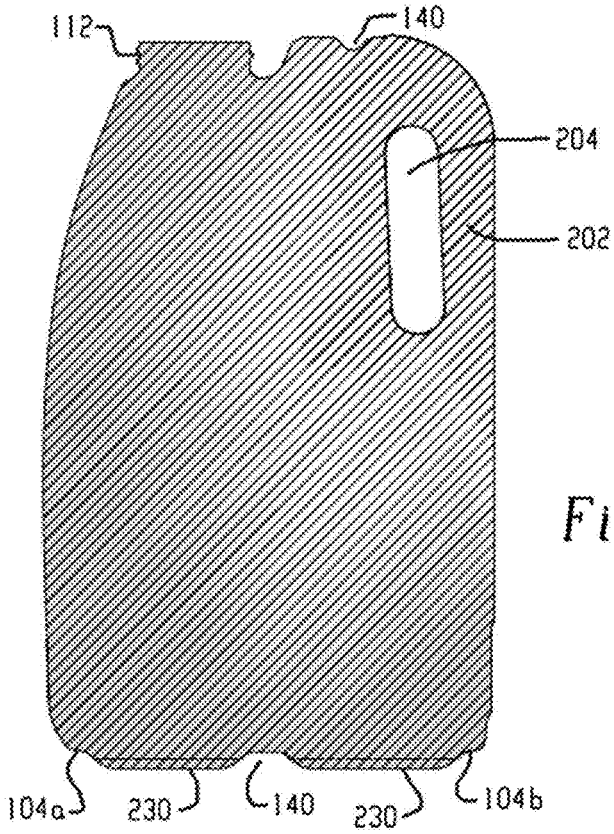
FIG. 26 is a cross-sectional elevational view of the subject new bottle with a continuous, uninterrupted compliant pleat and pressure building regions in the bottom wall of the bottle.
Figure 27:
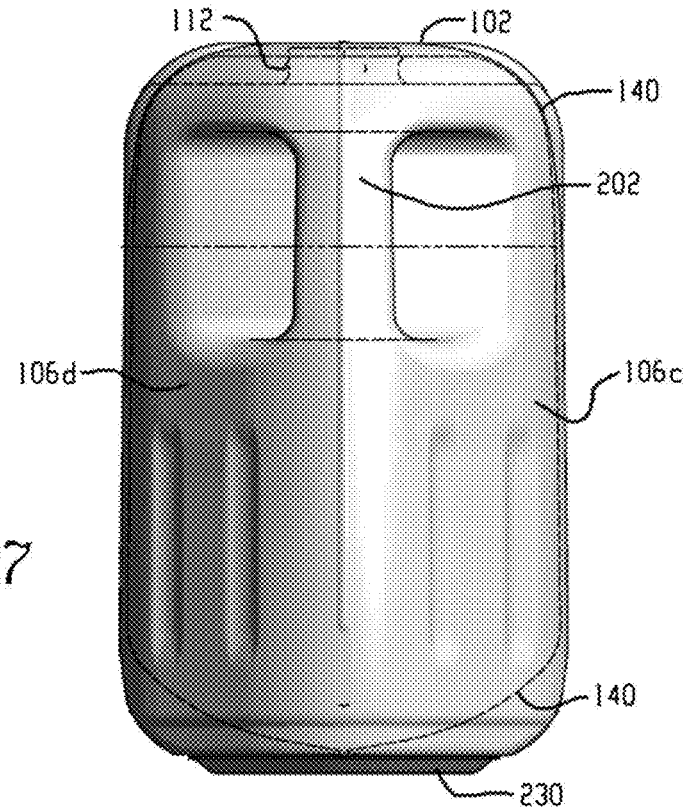
FIG. 27 is an elevational view taken generally from the right-hand side of FIG. 26.

FIGS. 6 and 7 illustrate the effect on the bottle 100 as a result of the imposed preload. The upper wall 102 undergoes substantial vertical displacement in the areas shown in red, yellow, and green without the cap 120 providing a pressure vessel (FIG. 6), whereas the vertical displacement is substantially reduced in the same areas (FIG. 7) when the lateral preload is applied to the closed bottle 100. In other words, the increased internal pressure in a sealed bottle 100 subject to a lateral load that reduces the internal volume of cavity 108 as a result of the movement of the first and second compartments 130, 132, allows increased loading (i.e., increased forces) in a vertical direction whereby the vertical displacement of the upper wall 102 is reduced. This provides increased stability to filled bottles in a stacked array.

A diameter of the opening 110 is also substantially reduced in the present disclosure over that of the caseless bottle of the prior art shown and described in commonly owned U.S. Pat. Nos. 6,068,161; 6,247,507; and 6,371,172. For example, the diameter of the opening in the prior art is 48 mm whereas the new diameter is 43 mm. Although the precise dimensions can vary, by reducing the diameter of the opening 110 and the cap 120, a greater amount of pressure can be held in the bottle 100. Of course the ability to hold greater pressure in the bottle 100 allows the lateral force to be applied or increased to the sidewall 106 which, in turn, allows the first and second compartments 130, 132 to move toward one another, i.e. the hinge/pleat 140 collapses. The individual bottle 100 and array of bottles preclude plastic deformation of the bottle walls and allow the sealed bottles to build pressure and advantageously and effectively carry the vertical.

FIGS. 8-11 illustrate another embodiment of a bottle 100 with the mechanical pressurizing feature provided by hinge 140 in response to a lateral load imposed on the bottle. The primary distinction of the embodiment of FIGS. 8-11 relative to the earlier described embodiment FIGS. 1-7 is that a generally conventional pass-through handle 200 is used. The handle 200 includes a hollow post 202 formed along the outer perimeter of the bottle 100 at the interface between sidewall portions 106*c*, 106*d*. The post 202 is separated from the remainder of the sidewall portions by elongated opening 204. The elongated opening 204 is dimensioned to receive the fingers of a user therethrough in a manner well known in the art.

FIGS. 12-15 also include a pass-through handle as described above in conjunction with the embodiment of FIGS. 8-11 and also eliminates use of any ribs in the sidewall portions 106*a*-106*d*. The bottle 100 incorporates the pressure building feature associated with the hinge/pleat 140 and entirely eliminates use of the ribs for transferring load in a vertical direction.

FIGS. 16-19 shows another embodiment of the present disclosure that incorporates pressure building regions 210 provided in sidewall portions 106*a*-106*d* of the bottle 100. In this particular embodiment, the pressure building regions 210 are spaced apart, normally indented, circular-shaped regions. Moreover, the pressure building regions 210 may be differently sized and need not all be similarly shaped or similarly sized. The shape and size of the different regions, as well as their particular location on the bottle may be varied to meet the demands of the lateral load imposed on the bottle by the wrap.

FIGS. 20-23 illustrate a different type of pressure building region 220. In this embodiment, the pressure building regions 220 are again provided in sidewall portions 106*a*-106*d* of the bottle 100. The pressure building regions 220 are shown as circular-shaped regions, the regions normally protrude outwardly from the remainder of the sidewall portions, and here are shown as generally equi-spaced and of substantially the same dimension. Of course one skilled in the art will realize that the pressure building regions 220 can be variably located and also variably sized without departing from the scope and intent of the present disclosure.

FIGS. 24-27 illustrate the use of pressure building regions 230 in the bottom wall 104. These figures demonstrate how pressure building regions 230 can also be included so that as the bottles are disposed in a stacked array, generally vertically directed forces will lead to a preload on the bottle that overcomes the normal unpressurized state of the bottle urging the regions 230 outwardly and thus deflecting these regions into the remainder of the plane of the bottom wall 104. Since the bottle 100 has been sealed by cap 120, the internal volume of cavity 108 is decreased thus leading to an increased pressure in the bottle. This arrangement can be used separately from or in conjunction with the laterally imposed forces provided by the wrap to further regulate the pressure of the sealed bottle 100.

These various arrangements provide for increased stability of the bottles 100, particularly when in a stacked array and subjected to a dynamic situation such as shipping and handling. The various designs shown and described above provide for a stronger bottle 100 and therefore allow for a reduction in material since the sealed bottle is able to handle increased pressure. Since the thickness of the walls 102, 104, 106 of the bottle 100 are controlled via the blow molding operation, the walls can flex as desired in response to the lateral or vertical loads which reduces the interior volume of the cavity 108 and increases the pressure of the sealed bottle. Moreover, the walls 102, 104, 106 will not encounter a permanent change in the conformation of the bottle 100, i.e., when the bottle is subsequently opened for use, the bottle will reshape to its original contour since the elastic yield strength of the plastic will not have been exceeded. The hinge/pleat 140 is designed to form first and second compartments 130, 132 that can move relative to one another under load when the bottle 100 has been sealed by the cap 120. Moreover, the design provides for improved pouring, the smaller diameter cap 120 allows greater pressure to be held, and less resin or plastic material is required to form the new bottle. For example, the ratio of resin (measured in grams) per bottle volume (measured in gallons) is on the order of 75 grams/gallon. The bottle 100 can also be advantageously used with a conventional filler with only minor modification thereto.

This written description uses examples to describe the disclosure, including the best mode, and also to enable any person skilled in the art to make and use the disclosure. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

It is claimed:

1. A bottle for storing an associated fluid product when filled, like bottles are positioned in a stacked array, the bottle comprising:

a first wall having an opening therein that is selectively opened and closed to allow the associated fluid product to be dispensed therethrough or stored in the bottle, respectively;

a second wall spaced from the first wall;

a third wall extending between the first and second walls; and a compliant pleat that extends continuously in a closed loop around the first wall, second wall, and the third wall along substantially an entirety of the first wall, second wall, and third wall and divides the bottle into first and second bottle portions, the compliant pleat having a reduced wall thickness less than a wall thickness of the first wall, the second, and the third wall allowing the first and second bottle portions to move toward one another in response to a predetermined force and thereby increase pressure in the closed bottle.

2. The bottle of claim 1 wherein the pleat extends in a plane that is substantially perpendicular to the first wall.

3. The bottle of claim 1 wherein the pleat extends in a plane that is substantially perpendicular to the second wall.

4. The bottle of claim 1 wherein the pleat is formed by a creased fold in the first wall, second wall, and third wall, wherein in the absence of the predetermined force, the first and second portions of the bottle are spaced apart by the pleat, and in response to a lateral force at least as great as the predetermined force imposed on the bottle, the pleat collapses and the first and second portions of the bottle abut one another.

5. The bottle of claim 1 further comprising a wrap encompassing outer, perimeter surfaces of filled, closed bottles in a stacked array, the wrap imposing a first preload force on the stacked array of bottles so that the pleats on individual bottles collapse and allow the first and second bottle portions thereof to move toward one another and increase the pressure in the individual bottles.

6. The bottle of claim 5 wherein the bottle is formed to include at least one region extending outwardly from one of the first, second, and third walls, the region configured to collapse inwardly toward the respective wall in which the region is formed when the bottle is filled and in response to a preload imposed on the respective wall.

7. The bottle of claim 1 further comprising a resin gram to volume ratio of 75 grams/gallon.

8. The bottle of claim 1 wherein the bottle has a parallelepiped conformation and the third wall is a sidewall that includes first, second, third, and fourth sidewall portions in which the first and third sidewall portions are substantially parallel to each other and substantially perpendicular to the second and fourth sidewall portions, and the second and fourth sidewall portions are substantially parallel to each other.

9. The bottle of claim 8 wherein the first wall and the second wall of the bottle each has a planar area for engagement with a second wall and first wall, respectively, of an adjacent like bottle in stacked relation.

10. The bottle of claim 1 wherein the third wall is a sidewall that includes first, second, third and fourth sidewall portions, a first corner region formed by an intersection of the first and second sidewall portions has a tapered contour at one end adjacent the opening, and the opening is located closer to a vertical center of the bottle than to non-tapered portions of the third wall.

11. The bottle of claim 10 wherein the third wall includes a handle formed therein at a second corner region formed by an intersection of the third and fourth sidewall portions and generally opposite the first corner region.

12. The bottle of claim 11 wherein the handle is a non-pass-through handle.

13. The bottle of claim 8 wherein the bottle has a handle formed along an interface of the third and fourth sidewall portions.

14. A bottle for storing an associated fluid product when filled, the bottle comprising:

a first wall having an opening therein that is selectively opened and closed to allow the associated fluid product to be dispensed therethrough or stored in the bottle, respectively;

a second wall spaced from the first wall;

a third wall extending between the first and second walls, wherein the third wall includes first, second, third and fourth sidewall portions, a first corner region formed by an intersection of the first and second sidewall portions, and a second corner region, formed by an intersection of the third and fourth sidewall portions and generally opposite the first corner region; and a compliant pleat that extends along substantially an entirety of the first wall, second wall, and third wall and divides the bottle into first and second bottle portions, the compliant pleat having a reduced wall thickness less than a wall thickness of the first wall, the second, and the third wall allowing the first and second bottle portions to move toward one another in response to a predetermined force and thereby increase pressure in the closed bottle, and the compliant pleat extending along the first wall at a location between the opening and the handle.

15. The bottle of claim 14 wherein the compliant pleat extends continuously in a closed loop around the first wall, second wall, and the third wall.

16. The bottle of claim 14 further comprising a wrap encompassing outer, perimeter surfaces of filled, closed bottles in a stacked array, the wrap imposing a first preload force on the stacked array of bottles so that the pleats on individual bottles collapse and allow the first and second bottle portions thereof to move toward one another and increase the pressure in the individual bottles.

17. The bottle of claim 16 further comprising a flexible label that extends about the third wall and is dimensioned to impose a second preload force on each bottle and increase the pressure in the bottle.

18. The bottle of claim 16 wherein the bottle is formed to include at least one region extending outwardly from one of the first, second, and third walls, the region configured to collapse inwardly toward the respective wall in which the region is formed when the bottle is filled and in response to a preload imposed on the respective wall.

19. The bottle of claim 14 wherein the third wall includes first, second, third and fourth portions, a first corner region formed by an intersection of the first and second portions has a tapered contour at one end adjacent the opening, and the opening is located closer to a vertical center of the bottle than to the non-tapered portions of the third wall, and the compliant pleat extends from the first wall to the second wall along the third wall, and a portion of the compliant pleat proceeds at an angle that is roughly parallel with the tapered contour of the first corner region.

20. The bottle of claim 1 wherein the third wall includes first, second, third and fourth portions, a first corner region formed by an intersection of the first and second portions, and a second corner region, formed by an intersection of the third and fourth portions and generally opposite the first corner region, the opening in the first wall is adjacent the first corner region, and the bottle further comprising a handle in the third wall along the second corner region, wherein the compliant pleat extends along the first wall between the opening and the handle.

21. A bottle for storing an associated fluid product when filled, the bottle comprising:

a first wall having an opening therein that is selectively opened and closed to allow the associated fluid product to be dispensed therethrough or stored in the bottle, respectively;

a second wall spaced from the first wall;

a third wall extending between the first and second walls, a taper region of the third wall extending toward a central axis of the bottle as the third wall extends toward the opening in the first wall; and a compliant pleat that extends along substantially an entirety of the first wall, second wall, and third wall and divides the bottle into first and second bottle portions, the compliant pleat having a reduced wall thickness less than a wall thickness of the first wall, the second, and the third wall allowing the first and second bottle portions to move toward one another in response to a predetermined force and thereby increase pressure in the closed bottle, and the compliant pleat extending along the first wall at a location between the opening and the handle, and the compliant pleat extending parallel to the third wall and including an angle that is parallel to the taper region of the third wall.

22. The bottle of claim 21 wherein the third wall is a sidewall that includes first, second, third, and fourth sidewall portions in which the first and third sidewall portions are substantially parallel to each other and substantially perpendicular to the second and fourth sidewall portions, and the second and fourth sidewall portions are substantially parallel to each other, a first corner region formed by an intersection of the first and second sidewall portions has a tapered contour at one end adjacent the opening and the handle located at a second corner region opposite the first corner region formed by an intersection of the third and fourth sidewall portions.

23. The bottle of claim 22 wherein the compliant pleat extends along the first wall at a location between the opening and the handle.

* * * * *